US006294786B1

(12) United States Patent
Marcichow et al.

(10) Patent No.: US 6,294,786 B1
(45) Date of Patent: Sep. 25, 2001

(54) ELECTRONIC FAUCET SENSOR ASSEMBLY

(75) Inventors: Martin E. Marcichow, Hoffman Estates; Steven R. Oliver, Chicago, both of IL (US)

(73) Assignee: Sloan Valve Company, Franklin Park, IL (US)

( * ) Notice: Subject to any disclaimer, the term of this patent is extended or adjusted under 35 U.S.C. 154(b) by 0 days.

(21) Appl. No.: 09/200,392

(22) Filed: Nov. 24, 1998

(51) Int. Cl.[7] ..... E03C 1/05

(52) U.S. Cl. ..... 250/341.1; 4/623; 137/801; 251/129.04

(58) Field of Search ..... 250/241.1; 4/623; 137/801; 251/129.04

(56) References Cited

U.S. PATENT DOCUMENTS 5,224,509 * 7/1993 Tanaka et al. ..... 137/315

5,555,912 * 9/1996 Saadi et al. ..... 137/801

* cited by examiner

*Primary Examiner*—Constantine Hannaher
(74) *Attorney, Agent, or Firm*—Cook, Alex, McFarron, Manzo, Cummings & Mehler, Ltd.

(57) ABSTRACT

An electronic faucet sensor assembly includes a base having a pair of openings facing in a generally downward direction when the assembly is mounted in an electronically operated faucet. There is an infrared transmitter positioned in one of the openings and an infrared receiver positioned in the other opening. There is a lens mounted to the base and covering the transmitter and a second lens mounted to the base and covering the receiver. Electrical lead wires are attached to the transmitter and to the receiver and the lead wires extend through a channel located in the base. There is a strain relief at one end of the channel and there is a rib to isolate the leads extending between the strain relief and the transmitter and receiver so as to prevent electrical contact therebetween. The channel is filled with a potting compound to provide a watertight environment for the electrical components.

8 Claims, 2 Drawing Sheets

ELECTRONIC FAUCET SENSOR ASSEMBLY

THE FIELD OF THE INVENTION

The present invention relates to a sensor assembly for an electronically operated faucet and more specifically to such a sensor assembly which provides a watertight environment for the light emitting diodes used in the sensor assembly. The invention further provides a strain relief for the lead wires for the LEDs as well as eliminating the need for a printed circuit board. In general, the various components of the sensor assembly provide a simply constructed, reliable device which is completely watertight in an environment in which there is both water flow and stray moisture.

The sensor assembly has a body, with side walls and end walls, with one of the end walls functioning in cooperation with a boss to provide a strain relief for the lead wires. The walls define a channel. There are openings in the body for the transmitter and receiver LEDs, with the wires for the transmitter and receiver being located in the channel between the side walls of the body. A longitudinally extending rib in the body separates the lead wires to prevent shorts and the entire area of the channel will be filled with a suitable potting compound, such as epoxy, to completely imbed the leads and their connection to the LEDs in a watertight compound, thus forming a waterproof sensor assembly.

SUMMARY OF THE INVENTION

The present invention relates to a sensor assembly for use in electronic faucets and particularly to such a sensor assembly which eliminates the need for a printed circuit board and which provides for encapsulation of the leads in a water resistant compound such as epoxy.

A primary purpose of the invention is to provide a sensor assembly of the type described in which the leads and the wire connections are placed in a waterproof environment.

Another purpose is a sensor assembly as described in which there is a strain relief eliminating any possibility of the wires being accidentally pulled away from the light emitting diodes forming the transmitter and receiver.

Another purpose is a sensor assembly of the type described which uses a potting compound to waterproof the connections to the light emitting diodes and uses rubber seals to prevent moisture from beneath the sensor assembly from reaching the light emitting diodes.

Another purpose is a sensor assembly as described which includes slots in the bottom of the base so that the epoxy or potting compound will be directly applied to the connections between the leads and the light emitting diodes.

Other purposes will appear in the ensuing specification, drawings and claim.

BRIEF DESCRIPTION OF THE DRAWINGS

The invention is illustrated diagrammatically in the following drawings wherein.

DESCRIPTION OF THE PREFERRED EMBODIMENT

Electronically operated faucets are commonly found in commercial washrooms. Customarily, a user will place his hands beneath the faucet, which will cause a light beam, for example infrared, to be reflected from the transmitter to the receiver, both located on the underside of the faucet. Such reflection will provide a signal which will operate a valve, normally a solenoid, to start the flow of water through the faucet. Usually the faucet will be operated for a predetermined period of time.

This type of environment presents certain hazards to continued and successful operation of the electronic controls for the faucet. There is both the flow of water through the faucet spout in which the electronic assembly is located and there is also the inherent danger from water being splashed upwardly from the sink or the hands of the user into the electronics which could provide a short circuit and a consequent malfunction. Thus, it is necessary to insure that the sensor control assembly is completely waterproof and is not susceptible to water either from within the faucet or from directly outside of the faucet spout. The present invention is directed to that end.

Figures 1, 2:
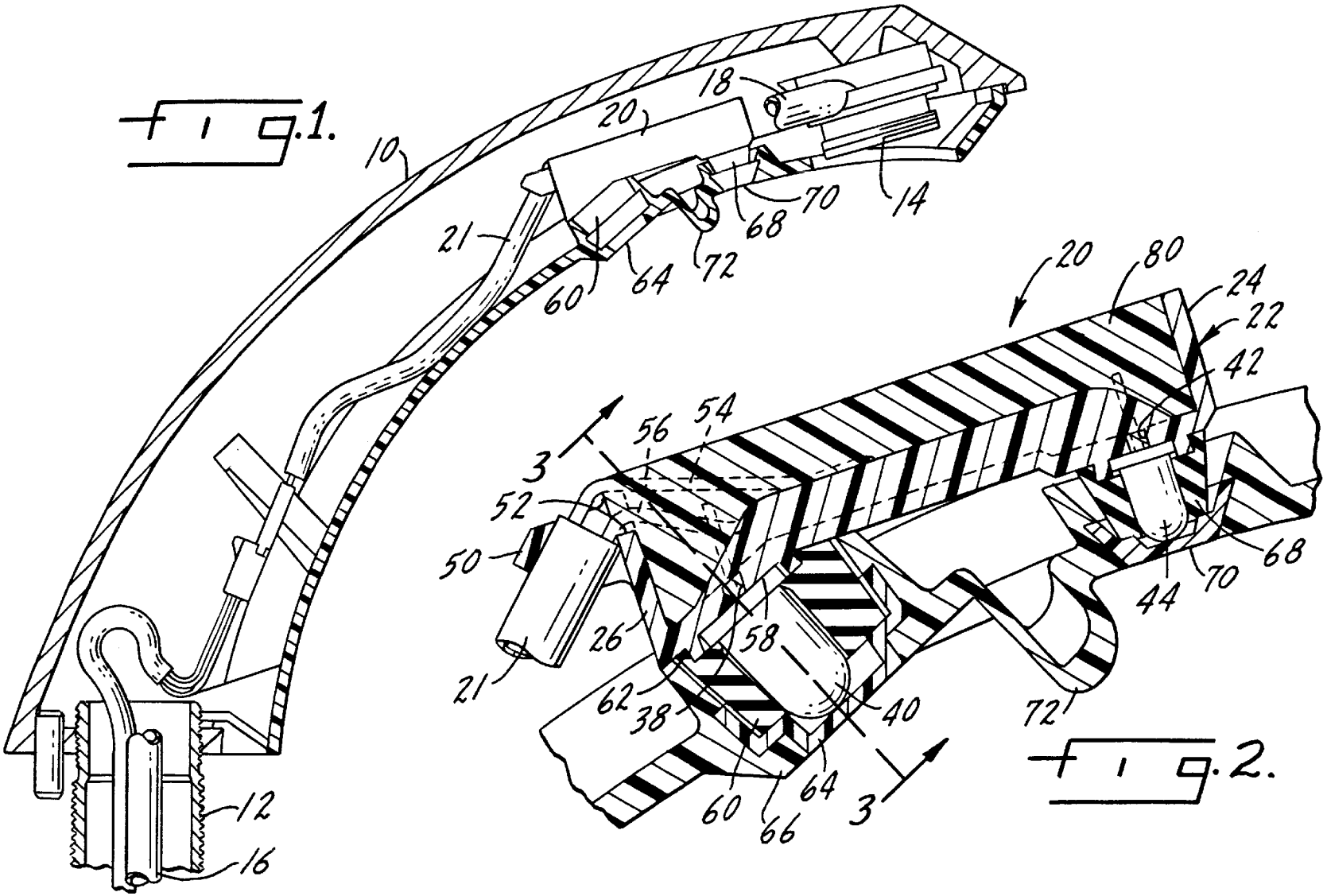
FIG. 1 is a side view, in part section, showing the principal components of an electronically operated faucet.
FIG. 2 is an enlarged vertical section through assembly of FIG. 1.

In FIG. 1, the faucet spout housing is indicated at 10 and the spout housing will be mounted on an upstanding mounting member 12. There is a faucet discharge indicated at 14. Normally, there will be a water conduit inside of the housing 10 which will direct water to the discharge 14. The inlet end of this conduit is indicated at 16 and the outlet end is indicated at 18, all in FIG. 1.

The electronic sensor control assembly is indicated at 20 and is connected by a wires assembly 21, which contains the control wire for the transmitter and receiver. The control wires will then be connected to suitable components, for example a solenoid and power supply, to operate the valve controlling the flow of water through the spout.

Figure 4:
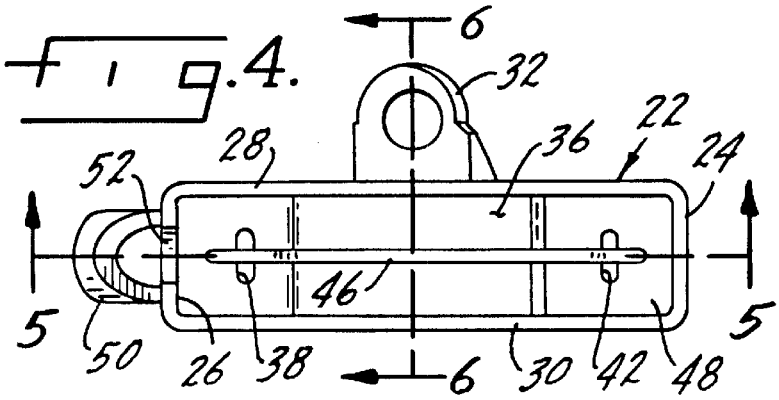
FIG. 4 is a top view of the base of the sensor assembly.
Figure 6:
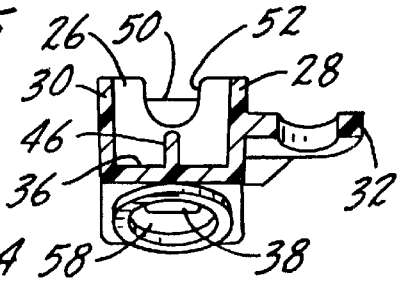
FIG. 6 is a section plane 6—6 of FIG. 4.
Figure 5:
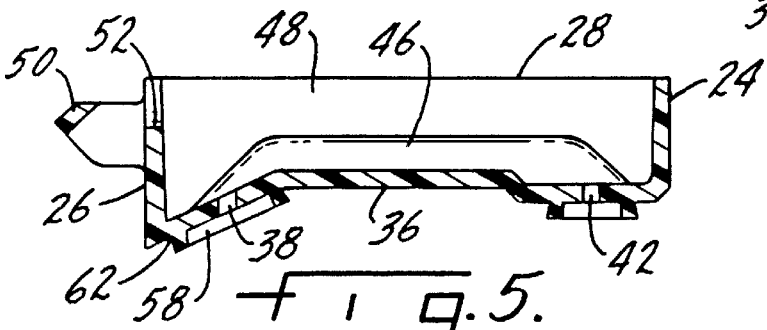
FIG. 5 is n along plane 5—5 of FIG. 4.

FIG. 2 illustrates the control assembly 20. There is a base 22 which has end walls 24 and 26 and side walls 28 and 30. The base has an outwardly extending bracket 32, shown particularly in FIGS. 3 and 4, which is used to attach the control assembly to the faucet spout housing 10. A screw for use in this attachment is illustrated at 34. The base 22 further has a bottom wall 36 which has an opening 38 providing access to the LED 40 functioning as the transmitter and an opening 42 providing access to the LED 44 functioning as the receiver. The bottom of the base 22 further has an upstanding longitudinally extending rib 46 which divides the channel 48 formed between the side walls 28 and 30 into two areas thereby providing a means for isolating the lead wires running to the transmitter and receiver.

The base 22 further has a boss 50 integrally formed with end wall 26, which end wall has a small slot 52. The combination of the boss and the slot 52 in the end wall 26 provide a strain relief for the electrical wires extending from the conduit 21 and into the area of the base 22. The wire pairs are identified at 54 and 56 in FIG. 2 and are shown in more detail in FIG. 3.

The LED 40 extends into a recess 58 in the bottom 36 of the base 22. Surrounding the LED 40 is an annular seal member 60 which extends circumferentially about the LED 40 and provides a watertight seal between the area outside of the LED and the interior of the base 22. The bottom 36 of the base may have an undercut at 62 so that the seal may be snapped in place and held about the LED during assembly. There is a lens 64 which surrounds both the LED and the seal, with the lens being retained in a bottom portion 66 of the faucet spout housing 10.

The mounting for the LED 44 is essentially the same as the mounting for LED 40, the only difference being the size of the components. There is a seal 68 and a lens 70, with these elements performing the same function as they do in connection with LED 40.

The bottom of the spout housing 10 may have a downwardly extending projection 72 which functions to isolate the transmitter and receiver such that no light can be passed directly therebetween. This eliminates false readings at the receiver and insures that any energy which is received by the receiver in fact is reflected by an object below the transmitter.

Figure 3:
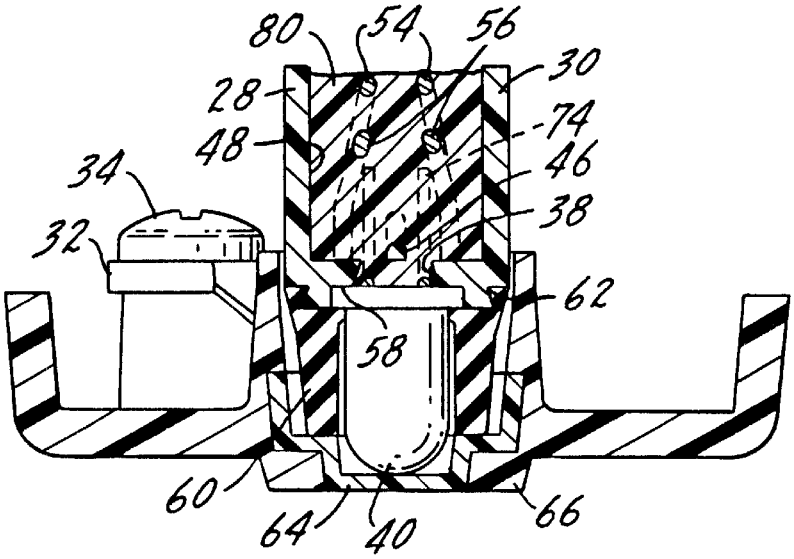
FIG. 3 is a section along plane 3—3 of FIG. 2.

After the elements described have been assembled in the base 22, a suitable potting compound 80, for example an epoxy, will fill the channel 48 extending between the side and end walls of the base. his epoxy will completely waterproof the electrical connections between the wires 54 and 56, each of which contains two independent leads, as particularly shown in FIG. 3. These leads will be directly connected to the contacts 74 of the LEDs, although such direct connection is not shown. Further, the longitudinally extending rib 46 will separate the lead wires and the electrical connections, preventing any short circuit between the wire pairs connected to the transmitter and to the receiver. The potting compound will flow down through the openings 38 and 42 so that the waterproof material will flow to the back of the LED to completely encapsulate the leads. This eliminates any potential for moisture reaching any portion of the electrical circuit.

In prior electronic faucets there was normally a printed circuit board located within the faucet spout housing. The inclusion of a PC board at this location caused severe problems with moisture. The present invention eliminates the need for a PC board, as there is direct connection to the LEDs, with the direct connecting wires passing out of the faucet spout to the appropriate control elements. The wires are isolated one from another by the use of a rib and waterproofing is provided by the inclusion of a potting compound which completely surrounds the LEDs at the point of electrical connection, as well as the wires connected to the LEDs. To further waterproof the device, there is a seal at the output side of each LED, thus eliminating the potential for moisture from beneath the faucet spout reaching the electrical areas of the control assembly.

Whereas the preferred form of the invention has been shown and described herein, it should be realized that there may be many modifications, substitutions and alterations thereto.

The embodiments of the invention in which an exclusive property or privilege is claimed are defined as follows:

1. An electronic faucet sensor assembly for use in an electronically operated faucet, and separate from a faucet waterway, said assembly including a base, a pair of spaced openings in said base facing in a generally downward direction when the assembly is mounted in an electronically operated faucet, an infrared transmitter positioned at one of said openings and an infrared receiver positioned at the other of said openings, a lens mounted to said base and covering said one opening and the associated transmitter, a separate lens mounted to said base and covering said other opening and the associated receiver, electrical lead wires attached to said transmitter and to said receiver, said base having a strain relief for said lead wires, and means on said base located between said strain relief and said transmitter and receiver for isolating said lead wires from each other.

2. The assembly of claim 1 including a seal element surrounding the transmitter and receiver, respectively, and located inside of the lenses.

3. The assembly of claim 1 wherein said base includes a channel connecting said transmitter and receiver openings and said strain relief, the means on said base for isolating said lead wires includes a rib in said channel.

4. The assembly of claim 3 wherein said base includes spaced upstanding generally parallel side walls forming said channel, said rib being generally centrally located within said channel, with at least one of said lead wires being positioned between one base wall and said rib, and at least some of said lead wires being positioned between the other base wall and said rib.

5. The assembly of claim 4 further including a potting compound located between said base walls, covering said rib and the lead wires positioned within said channel to provide a moisture proof environment for the connection of said lead wires to said infrared transmitter and receiver.

6. The assembly of claim 4 wherein said base includes an end wall at opposite ends of said channel, said base further including a bottom, joining said side walls and end walls, said openings being formed in said bottom, with said openings permitting the flow of a potting compound to the area directly adjacent the transmitter and receiver.

7. The assembly of claim 6 wherein one of said end walls includes an opening forming a part of said strain relief.

8. The assembly of claim 3 wherein said strain relief includes a boss located at one end of said base, and an upstanding end wall directly adjacent said boss, said lead wires passing through said boss and over said upstanding wall and into said channel.

* * * * *